US005482572A

United States Patent [19]

Eggert et al.

[11] Patent Number: 5,482,572

[45] Date of Patent: Jan. 9, 1996

[54] METHOD FOR THE PREPARATION OF ALLOYS OF THE RARE EARTH METALS OF THE $SE_2FE_{17-X}TM_XN_Y$ TYPE

[75] Inventors: Horst Eggert, Dorsten; Michael Steinhorst, Essen, both of Germany

[73] Assignee: Th. Goldschmidt AG, Essen, Germany

[21] Appl. No.: 140,777

[22] Filed: Oct. 21, 1993

[30] Foreign Application Priority Data

Nov. 5, 1992 [DE] Germany ..... 42 37 346.8

[51] Int. Cl.[6] ..... H01F 1/059

[52] U.S. Cl. ..... 148/101; 148/102; 420/83

[58] Field of Search ..... 148/101, 102; 420/83

[56] References Cited

U.S. PATENT DOCUMENTS

| | | | |
|---|---|---|---|
| 3,826,696 | 7/1974 | Cech | 148/101 |
| 4,760,966 | 8/1988 | Finnegan et al. | 241/1 |
| 4,769,063 | 9/1988 | Ishigaki et al. | 420/83 |

FOREIGN PATENT DOCUMENTS

| | | |
|---|---|---|
| 0369097 | 3/1989 | European Pat. Off. . |
| 0453270 | 4/1991 | European Pat. Off. . |

OTHER PUBLICATIONS

Endoh et al, "$Sm_2(Fe,M)N_x$ Compounds and Magnets" J. of Applied Physics 70(1991) 15 Nov. pp. 6030–6032.

Coby et al, "Improved Magnetic Properties by Treatment of Iron–Based Rare Earth Intermetallic Compounds in Ammonia" J of Magnetism and Magnetic Materials 87(1990) L251–L254.

J. M. D. Coey, Improvement in cast structure . . . , 1992. pp. 251–258 J. of Alloys and Compounds 185(1992).

K. H. J. Buschow, The Samarium–Iron System, 1971, pp. 131–134 A. J. of Less Common Metals.

K. Schnitzke, High coercivity in $Sm_2$ $Fe_{17}$ $N_x$ magnets, 1990, pp. 2853–2855 Appl. Phys. Lett. 57(26) Dec.

*Primary Examiner*—John Sheehan

*Attorney, Agent, or Firm*—Anderson Kill Olio Oshinsky

[57] ABSTRACT

A method for the preparation of alloys of the $SE_2Fe_{17-x}TM_{xNy}$ type where SE stands for a rare earth metal, including Y or a mixture of these metals, while TM stands for Co, Ni, Cu, Zr, Ga, Hf, Ta, Nb, Ti, Si, A1, V, Mo, Cr, Zn or Sn or a mixture of these metals, x=0 to 10, y=>0 to 5 is described. The preparation involves calciothermal reduction of a finely divided, homogeneous mixture of the alloying components, subsequent diffusion of the components, followed by nitriding and separating the calcium oxide and excess calcium formed. The method is characterized by:

a) Preparation of an alloy of the $SE_2Fe_{17-x}TM_x$ by a1) Adjusting the exothermic reaction of the calciothermal reduction by the oxide content of the reaction mixture, so that $T_M$>TR $\geqq$0.9 $T_M$ where $T_M$ is the melting temperature of the intermetallic phase, and $T_R$ is the reaction temperature, a2) Using a reaction mixture having components, excepting calcium, of an average particle size of $\leqq$75 μm, a3) tempering the reaction product at the end at a temperature at least 0.7 times the melting temperature $T_M$ of the desired alloy, but less than the melting temperature $T_M$, b) Subsequently nitriding the alloy obtained with nitrogen or a mixture of nitrogen and hydrogen or $NH_3$.

4 Claims, 6 Drawing Sheets

METHOD FOR THE PREPARATION OF ALLOYS OF THE RARE EARTH METALS OF THE $SE_2FE_{17-X}TM_XN_Y$ TYPE

FIELD OF THE IVNENTION

The invention relates to a method for the preparation of alloys of the $SE_2Fe_{17-x}TM_xN_y$ type (SE stands for a rare earth metal, including Y, or a mixture of these metals, while TM stands for Co, Ni, Cu, Zr, Ca, Hf, Ta, ND, Si, Ti, Al, V, Mo, Cr, Zn or Sn or a mixture of these metals, x=0 to 10, y=>0 to 5), these alloys preferably having a magnetic anisotropy in the direction of the c axis. The method comprises calciothermal reduction of a finely divided, homogeneous mixture of the alloyinq components, of which at least one is present in the form of an oxide, subsequent diffusion of the alloying components, followed by nitriding by utilizing nitrogen or $NH_3$ and separating calcium oxide formed and any excess calcium.

BACKGROUND INFORMATION AND PRIOR ART

The present invention starts out from a method for the preparation of one-phase, intermetallic phases, which melt incongruously within a temperature range of 900° to 2,000° K. and have a homogeneity range of ≦10 atom percent at room temperature. These phases are prepared by the calciothermal reduction of a finely divided, homogeneous mixture of the alloying components, of which at least one is present in the form of an oxide, subsequent diffusion of the alloying components and separation of the calcium oxide formed and of any excess calcium. This method is the object of the German Offenlegungsschrift . ... ... (unpublished German patent application P 42 04 173.2 of 2-13-1992) and has the combination of the following characteristics:

a) Adjusting the exothermic energy of the calciothermal reduction by the oxide content of the reaction mixture, which corresponds in its composition to the desired single phase alloy, in such a manner that the temperature condition $T_M > T_R \geqq 0.9\ T_M$ (in degrees Kelvin) is fulfilled, and $T_M$ being the melting temperature of the intermetallic phase and $T_R$ being the reaction temperature, b) using a reaction mixture, the components of which, with the exception of calcium, have an average particle size of ≦75 μm, c) tempering the reaction product at the end of the exothermal reaction at a temperature, which is at least 0.7 times the melting temperature $T_M$ of the desired single phase alloy, measured in ° K., but in less than the melting temperature $T_M$, during a period of time sufficient for the diffusion of the components.

This method is the starting point of the present invention, which is concerned with the technical problem of producing alloys of the $Se_2Fe_{17-x}TM_xN_y$ type (x=0 to 10, y=> 0 to 5), which preferably have a magnetic anisotropy in the direction of the c axis, from alloys of the type $SE_2Fe_{17}$ (SE stands for a rare earth metal, including capital Y, or a mixture of these metals, and TM stands for Co, Ni, Cu, Zr, Ga, Hf, Ta, Nb, Ti, Si, A1, V, Mo, Cr, Zn or Sn or a mixture of these metals), based essentially on the single phase, incongruently melting intermetallic phase $SE_2Fe_{17}$ obtainable from the aforementioned method.

Alloys of the $Se_2Fe_{17-x}TM_xN_y$ are known from the state of the art. Compared to the base alloy, they have the advantage of a higher Curie temperature. For example, the Curie temperature of the $Sm_2Fe_{17}$ alloy is 130° C., while the Curie temperature of the $Sm_2Fe_{17}N_y$ alloy, with y=3, is 470° C.

Nitrides of the composition $RE_{60}\ Fe_{(100-\alpha-\beta-\gamma)}N\beta H_\gamma$ are described in the German Offenlegungsschrift 0 369 097, in which the subscripts have the following values in atom percent: α=5 to 20, β=5 to 30 and γ=0.01 to 10.

The European publication 0 453 270 is also concerned with the hard magnetic properties of nitrides of the aforementioned composition.

For the preparation of for example, $Sm_2Fe_{17}N_y$, an, as far as possible, single phase $Sm_2Fe_{17}$ is required as preliminary product, in order to convert this product subsequently by nitriding into the desired nitride. Frequently, the $Sm_2Fe_{17}$ is alloyed by different elements, in order to improve the nitriding behavior or, for example, the magnetic properties of the subsequently produced nitride. For example, by the addition of Nb to melt metallurgically produced $Sm_2Fe_{17}$, the soft magnetic α-Fe, which occurs unavoidably, can be bonded in the form of an intermetallic Laves phase of the composition $NbFe_2$ (A.E. Platts, I.R. Harris, J.R.D. Coye, Journal of Alloys and Compounds, 185, 251 (1992)). In this case, after the nitriding, $Sm_2Fe_{17}N_y$ is formed, from a multiphase pre-alloy, which is based, however, essentially on the intermetallic phase $Sm_2Fe_{17}$.

$Sm_2Fe_{17}$ is an incongruently melting intermetallic phase with a melting point of 1,280° C. At the melting point of the $Sm_2Fe_{17}$, the following thermodynamic equilibrium exists:

$Sm_2Fe_{17}$=α-Fe+Sm-rich melt, as described in J. Less-Common Metals, 25, 131 (1971).

While examining the magnetic properties of $Sm_2Fe_{17}Ny_y$, it was observed by means of a hysteresis curve that residues of α-Fe are still present. The presence of these residues decrease the coercive force of the desired nitride and should therefore be prevented as far as possible.

In order to be able to compensate for the unavoidable precipitation of α-Fe during the melt metallurgical preparation of $Sm_2Fe_{17}$, a time-consuming diffusion annealing of up to 2 hours at 1,000° C. is required.

The adjustment of a nanocrystalline structure represents a second possibility for obtaining $Sm_2Fe_{17}$. Schnitzke et al. (K. Schnitzke, L. Schultz, J. Wecker, M. Katter, submitted to Appl. Phys. Lett.) at first prepared a nanocrystalline $Sm_2Fe_{17}$ by mechanically alloying the element powder. Radiographic analysis of the powder revealed an amorphous phase and crystalline e-Fe. The intermetallic $Sm_2Fe_{17}$ phase is formed only during a subsequent heat treatment and is then converted by nitriding to the $Sm_2Fe_{17}N_y$ compound.

It is a disadvantage of this preparative method that only isotropic $Sm_2Fe_{17}N_y$ alloys can be produced.

The thermodynamically preferred reactions during the nitriding of $Sm_2Fe_{17}$ are:

$Sm_2Fe_{17}+N_2$ <====>2SmN+17Fe $Sm_2Fe_{17}+y/2N_2$ <====>$Sm_2Fe_{17}N_y$ <====>2SmN+(y−2)/2 $N_2$17Fe

These reactions are affected by temperature and duration of nitriding. With increasing temperature and/or length of time of nitriding, an increased formation of SmN and α-Fe is observed. The nitriding can be accelerated by decreasing particle size of the $Sm_2Fe_{17}$ because of a shorter diffusion path.

Consequently, at constant temperature and nitriding atmosphere, the parameters of particle size and length of time and temperature of the nitriding must be coordinated with one another in preliminary experiments, in order to be able to produce the required nitride in the desired purity.

It was found that the preparation of the nitride of the $Se_2Fe_{17-x}TM_xN_y$ type can be ensured in a manner that is simple from a chemical engineering point of view, with improved economic efficiency and in the required quality, by combining the calciothermal co-reduction with the nitriding in one process step and maintaining selected process conditions.

OBJECT OF THE INVENTION

An object of the invention is a method for the preparation of alloys of the $Se_2Fe_{17-x}TM_xN_y$ type. SE stands for a rare earth metal, including Y, or a mixture of these metals, while TM stands for Co, Ni, Cu, Zr, Ga, Hf, Ta, Nb, Ti, Si, A1, V, Mo, Cr, Zn or Sn or a mixture of these metals, x=0 to 10, y=>0 to 5). These alloys preferably have a magnetic anisotropy in the direction of the c axis. The alloys are prepared by calciothermal reduction of a finely divided, homogeneous mixture of the alloying components, of which at least one is present in the form of an oxide, subsequent diffusion of the alloying components, followed by nitriding by the action of nitrogen or $NH_3$ and separation of calcium oxide and any excess calcium formed characterized by the combination of the following process steps and characteristics, the temperatures being given in degrees Kelvin: a) Preparing of an alloy of the $SE_2Fe_{17-x}TM_x$ type by a1) adjusting the exothermicity of the calciothermal reduction by the oxide content of the reaction mixture, which corresponds in its composition to the desired alloy, by fulfilling the temperature condition that $T_M$>TR $\geqq 0.9\ T_M$ ($T_M$=melting temperature of the intermetallic phase, $T_R$=reaction temperature), a2) using a reaction mixture, the components of which (with the exception of calcium) have an average particle size of $\leqq 75$ μm, a3) tempering the reaction product at the end of the exothermic reaction at a temperature, which is at least 0.7 times the melting temperature $T_M$ of the desired alloy, but is less than the melting temperature $T_M$, during a period of time adequate for the diffusion of the components, a4) optionally acting upon the tempered reaction product with hydrogen up to, at most, the saturation of the alloy with hydrogen in a temperature range between room temperature and the decomposition temperature of the hydride of the alloy formed in steps a1) to a3) of the method, and b) subsequently nitriding the alloy obtained with nitrogen or a mixture of nitrogen and hydrogen or $NH_3$ in a temperature range between 473° K. and a temperature below the decomposition temperature of the nitride of formula $Se_2Fe_{17-x}TM_xN_y$.

SUMMARY OF THE INVENTION

Characteristics al) to a3) are concerned with the preparation of a preliminary alloy of the $Se_2Fe_{17-x}TM_xN_y$ type for the subsequent hydrogen treatment and nitriding.

Characteristic a4) of the inventive method is optional and serves to accelerate the subsequent nitriding. Using the $Sm_2Fe_{17}N_y$ nitride as example, this means that the lattice of the incongruently melting intermetallic $Sm_2Fe_{17}$ phase, which is the main component, can be expanded by the interstitial incorporation of hydrogen, which results, moreover, in comminuting the compound. Both effects promote the absorption of nitrogen during the subsequent nitriding. The decomposition temperature of the $Sm2Fe17H_z$ forming should therefore not be exceeded during the hydrogenation. This temperature is known from the literature or can be measured by previously carrying out a differential thermal analysis (NTA).

The decomposition temperature of the $Se_2Fe_{17-x}TM_xN_y$ nitride, formed in step b) of the method, must also not be exceeded during the nitriding according to characteristic b). In order to be able to carry out the nitriding in an appropriate time, a minimum temperature of 473° K. is required. Nitrogen or a mixture of nitrogen and hydrogen or ammonia can be used as nitriding atmosphere.

Preferably, in the event that step a4) of the method was carried out, the hydrogen is removed before the nitriding by applying a vacuum.

By preference, an alloy with a particle size of 5 to 100 μm (measured by the Fisher method) is selected for step b) of the method. The reason for this lies therein that the length of time, required for the nitriding in the same atmosphere and at constant pressure and temperature, depends on the diffusion path traveled, that is, on the particle size. The rate of the nitriding varies inversely with the particle size.

The inventive method is described in greater detail in the following:

PREPARATION OF $Sm_2Fe_{17}N_y$

For the preparation of $Sm_2Fe_{17}N_y$, metallic Fe, $Fe_2O_3$, $Sm_2O_3$ and calcium are used as raw materials. These raw materials are weighed out in proportion to the alloy composition desired and mixed homogeneously. Subsequently, the reaction mixture is pressed in a press to green compacts. These green compacts are filled into a reaction crucible, to which a lid is subsequently welded and which is then moved into a reaction furnace.

MEASURING THE AMOUNT OF Sm REQUIRED TO COMPENSATE FOR FURNACE AND METHOD LOSSES

Figure 1:
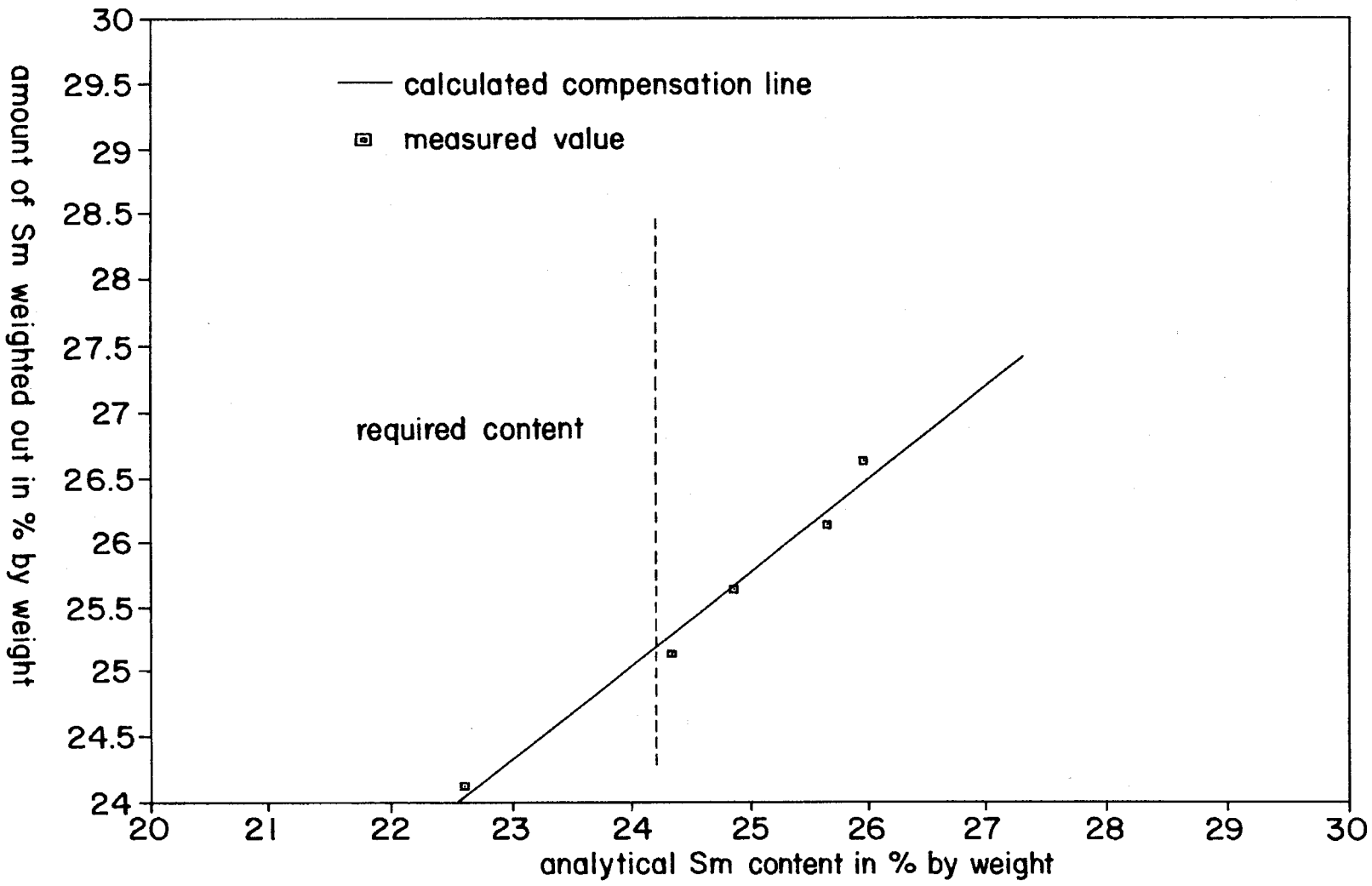
FIG. 1 shows the analytically detected Sm content of the SmFe alloy after the co-reduction process as a function of the SM concentration as $Sm_2O_3$ inthe mixture.

FIG. 1 shows the analytically detected Sm content of the SmFe alloy after the co-reduction process as a function of the Sm concentration as $Sm_2O_3$ in the mixture. An Sm concentration of 24.05% by weight is theoretically required to form the stoichiometric $Sm_2Fe_{17}$ compound. The experimentally determined curve of FIG. 1 indicates that 25.05% to 25.55% by weight of Sm must be used to compensate for the losses.

ADJUSTING THE EXOTHERMICITY OF THE METHOD

Figure 2:
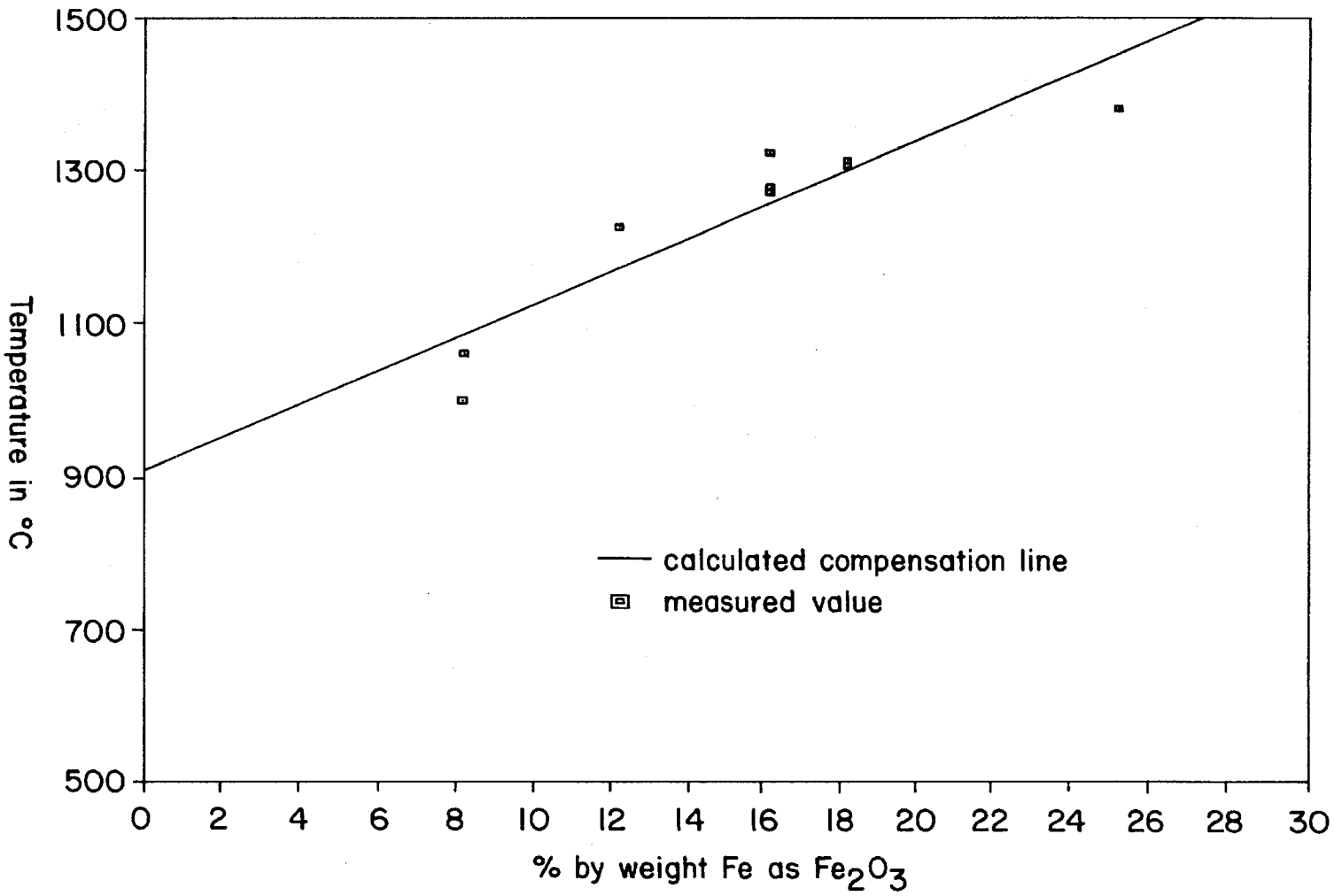
FIG. 2 shows the maximum reaction temperature attained as a function of the Fe concentration int he form of $Fe_2O_3$ in the reaction mixture.

By the selective addition of $Fe_2O_3$ to the reaction mixture, the reaction temperature in the reaction crucible is adjusted in relation to the melting point of the $Sm_2Fe_{17}$ of 1,553° K., without exceeding this melting point. In FIG. 2, the maximum reaction temperature attained during the exothermicity is shown as a function of the Fe concentration in the form of $Fe_2O_3$ in the reaction mixture. Taking into account the accuracy of the temperature measurement, the addition of 12% of the stoichiometrically required metallic Fe as $Fe_2O_3$ fulfills the selection rule of step a1) of the method. Taking into account the results of these preliminary experiments, the following reaction mixture is used:

| | |
|---|---|
| $Sm_2O_3$ | 1540.6 g |
| Fe | 3406.8 g |
| $Fe_2O_3$ | 664.0 g |
| Ca | 1185.2 g |

With the exception of Ca, the particle size of the raw materials named is less than 75 μm.

Figure 3:
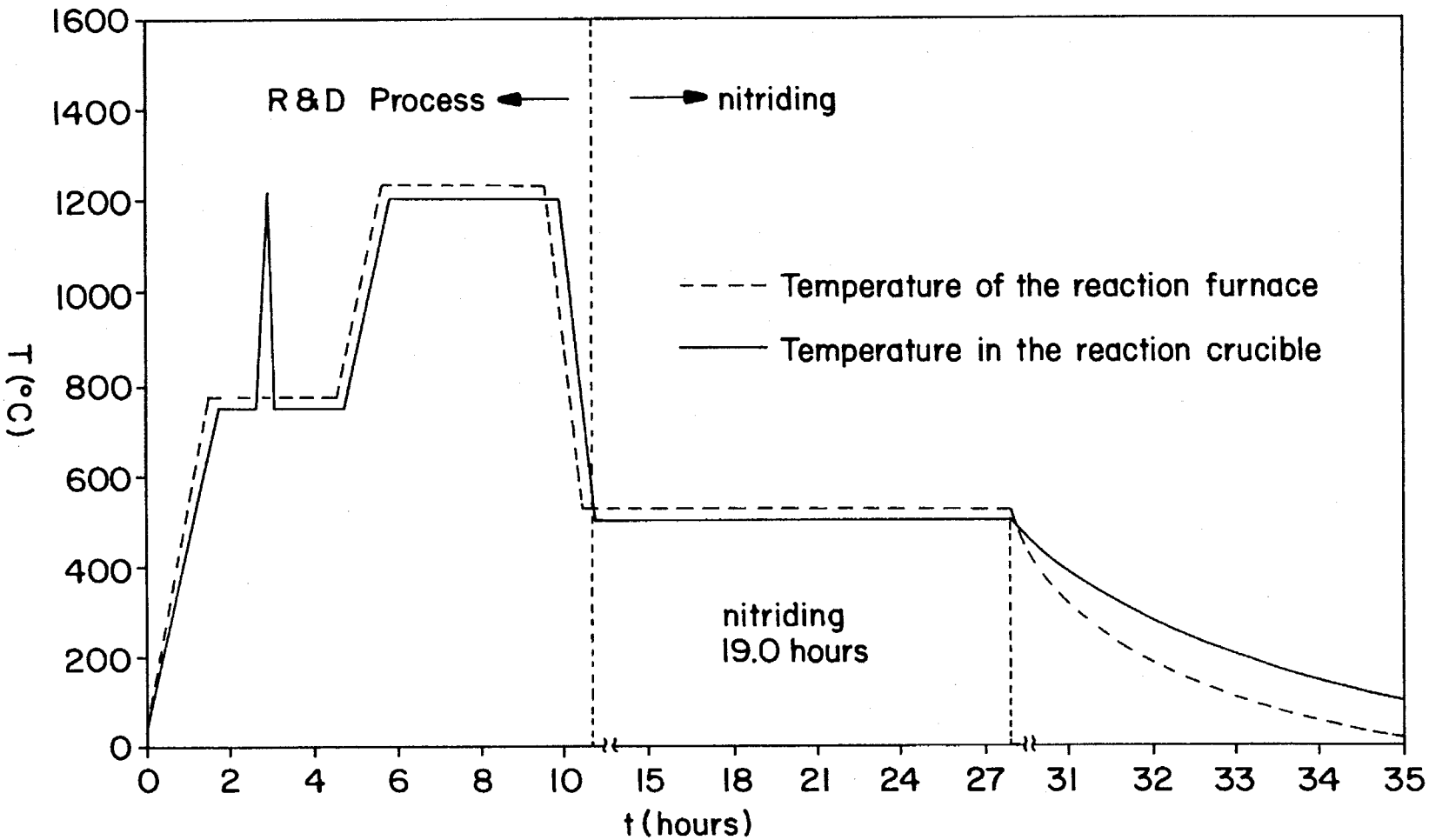
FIG. 3 shows the furnace temperature and the reaction mixture temperature as a function of time for the embodiment wherein there is no hydrogenation of the reaction mxiture prior to nitriding.
Figure 4:
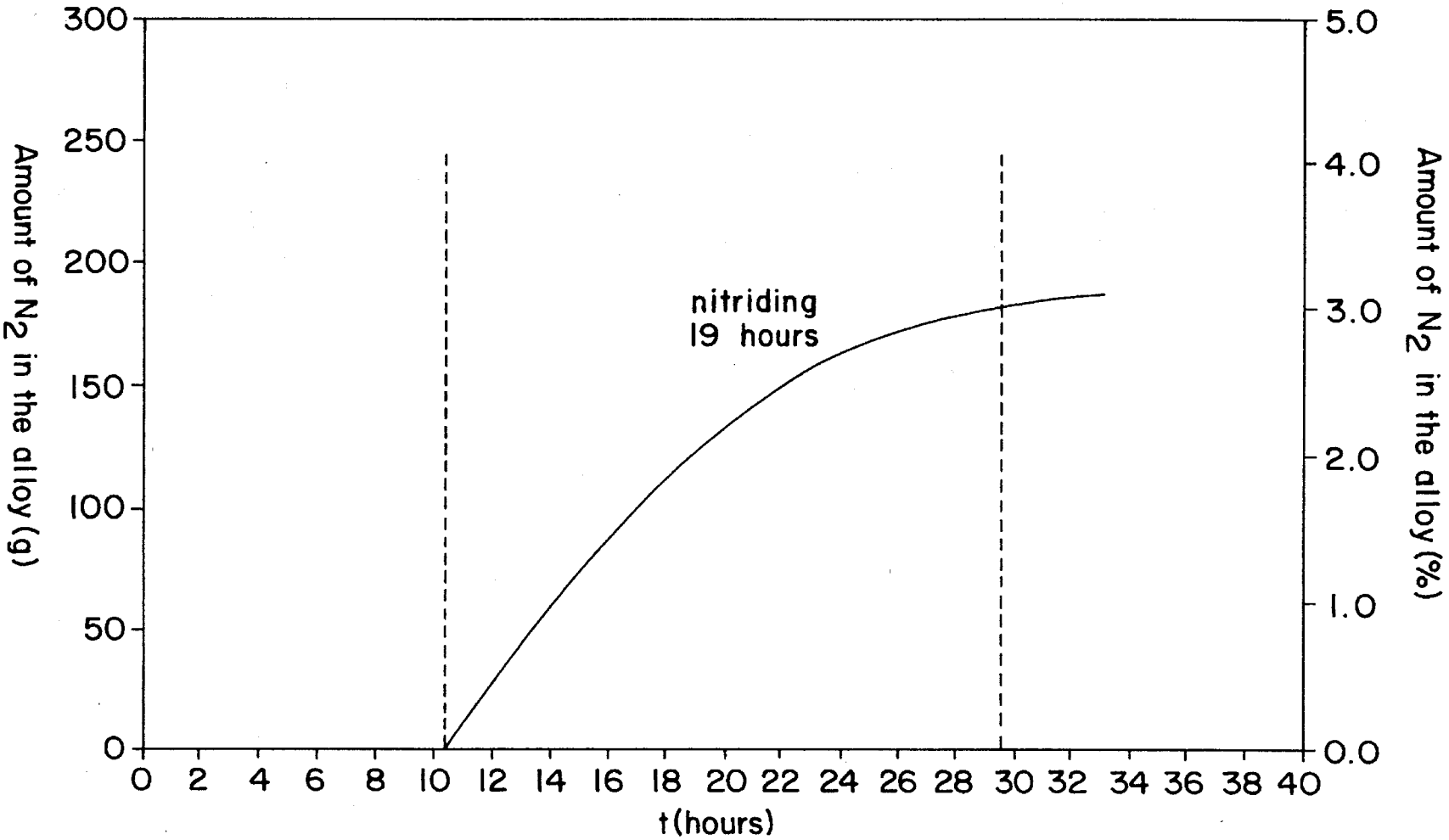
FIG. 4 shows the nitrogen content of the alloy as a function of time for the embodiment wherein there is no hydrogenation of the reaction mixture prior to nitriding.

The method is carried out according to the temperature program shown in FIG. 1. FIG. 3 shows the course of the associated temperature course of the furnace and in the reaction mixture. At no time during the reduction and diffusion process is the critical melting temperature of the $Sm_2Fe_{17}$ of 1,553° K. attained or exceeded. During the exothermicity, the maximum reaction temperature measured is 1,493°±55° K. After the diffusion, the temperature is lowered to 773° K. When the isothermal state is reached, nitrogen is passed in. Under the given conditions, a nitriding period of about 19 hours is required, after which saturation is observed in the nitrogen absorption (FIG. 4).

The reaction product is subsequently cooled to room temperature under nitrogen and freed in water from the CaO formed and from the excess calcium. The following chemical composition was typically noted:

TABLE 1

Chemical Composition of an Sm—Fe—N Alloy (A) Without Hydrogenation

| | |
|---|---|
| Sm | 24.6 ± 0.5% by weight |
| Fe | bal. |
| Ca | 0.1% by weight |
| O | 0.35% by weight |
| H | 0.15% by weight |
| N | 3.15 ± 0.1% by weight |
| SE | 24.75 ± 0.5% by weight |

The nitrogen absorption can be accelerated clearly by a prior hydrogenation. In this case, the tempered reaction product is cooled to a temperature of 523° K. and, in the isothermal state, hydrogen is passed into the crucible and the reaction mixture is loaded with hydrogen. According to X-ray diffraction analysis, a compound of the general composition $Sm_2Fe_{17}H_x$ is formed during the hydrogenation. A decomposition according to the equation $Sm_2Fe_{17}+2H_2 \Longleftrightarrow 2SmH_2+17\alpha\text{-}Fe$ could not be detected.

Figure 5:
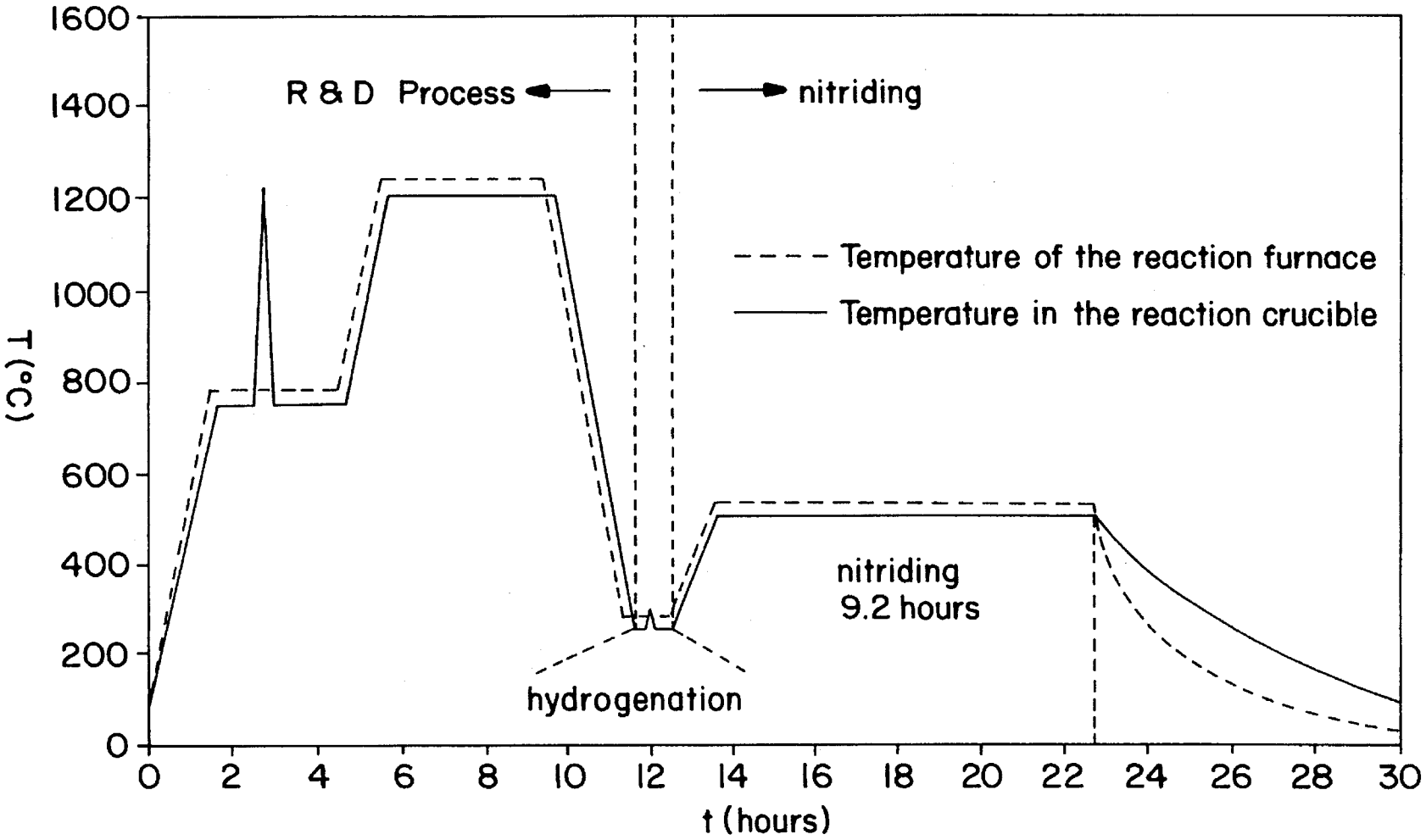
FIG. 5 shows the furnace temperature and the reaction mixture temperature as a function of time for the embodiment wherein the reaction mixture is hydrogenated prior to the nitriding.
Figure 6:
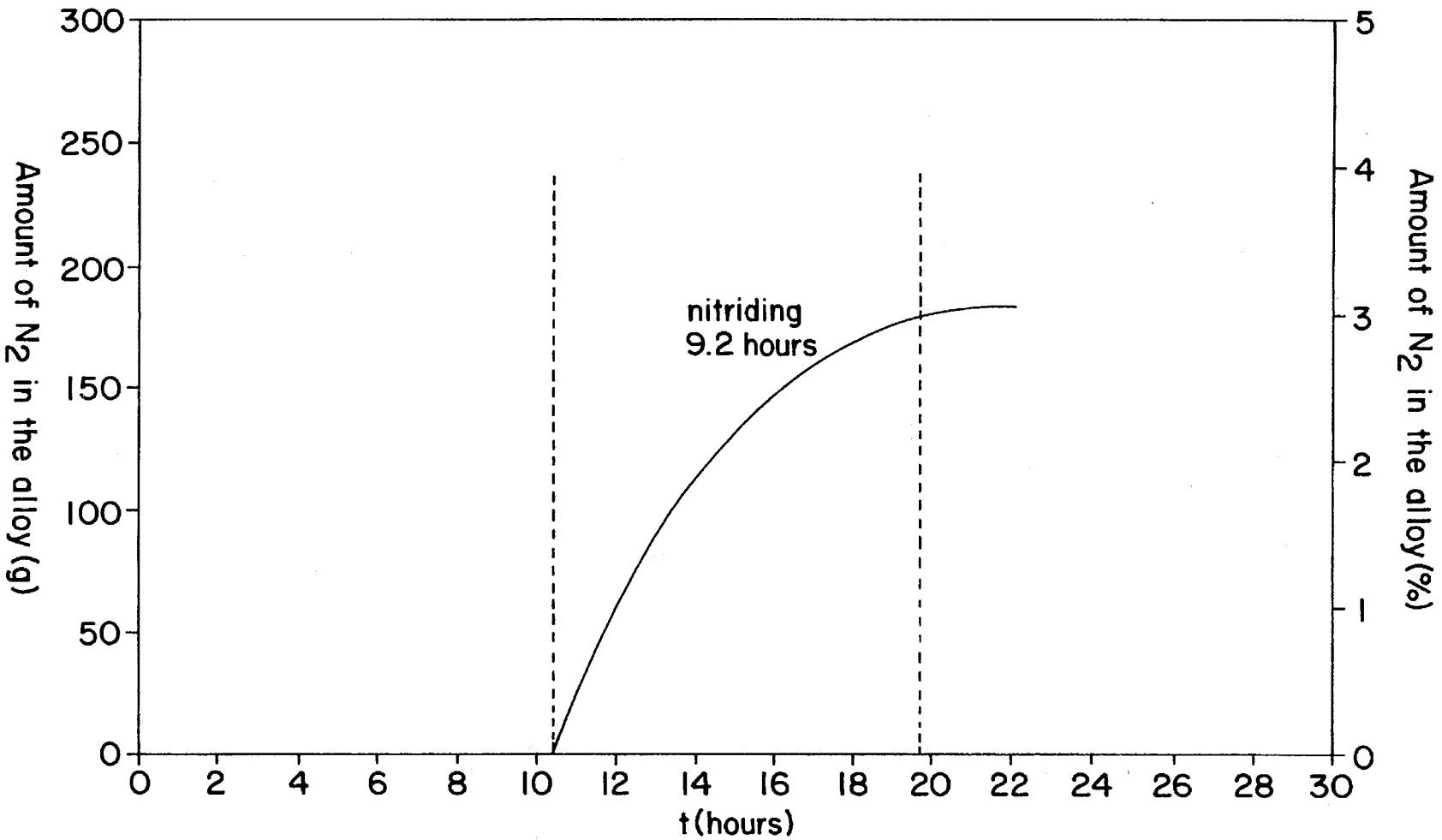
FIG. 6 shows the nitrogen content of the alloy as a function of time for the embodiment wherein the reaction mixture is hydrogenated prior to nitriding.

Subsequently, the crucible is flooded with nitrogen and heated to 773° K. The reaction mixture is then nitrided to saturation under isothermal conditions over a period of fewer than 10 hours (FIGS. 5 and 6).

Table 2 shows the typical chemical composition resulting after the reduction, diffusion, hydrogenation and nitriding processes:

TABLE 2

Chemical Composition of an Sm—Fe—N Alloy (B) with Hydrogenation

| | |
|---|---|
| Sm | 24.65 ± 0.5% by weight |
| SE | 24.75 ± 0.5% by weight |
| Fe | bal. |
| Ca | ≦0.1% by weight |
| O | ≦0.35% by weight |
| N | ≦3.3 ± 0.1% by weight |
| H | ≦0.15% by weight |

The comparison of the hydrogen concentration of Tables 1 and 2 shows that the analyzed hydrogen does not represent a deliberate addition to the alloy; instead, it is an unavoidable contamination resulting from the co-reduction process.

The chemical compositions, listed in Tables 1 and 2, were analyzed by X-ray diffraction. For both compositions, the following lattice parameters were observed.

| Composition | Structure $Th_2Zn_{17}$ | a (nm) | c (nm) |
|---|---|---|---|
| $Sm_2Fe_{17}$ | $Th_2Zn_{17}$ | 0.854 | 1.243 |
| (A) | $Th_2Zn_{17}$ | 0.876 | 1.271 |
| (B) | | 0.878 | 1.270 |

Accordingly, a nitride has been formed, which has the composition $Sm_2Fe_{17}N_{2.7}$.

We claim:

1. A method for preparing alloys of $Se_2Fe_{17-x}TM_xN_y$ formula wherein SE stands for a rare earth metal, including Y, or a mixture of these metals, while TM stands for Co, Ni, Cu, Zr, Ga, Hf, Ta, Nb, Ti, Si, Al, V, Mo, Cr, Zn or Sn or a mixture of these metals, x=0 to 10, and y=>0 to 5, said alloys having a magnetic anisotropy in the direction of the C axis, comprising the steps of:

a1) reducing calciothermally a finely divided, homogeneous mixture of components comprising the alloys, at least one of components being present in an oxide form and adjusting the exothermicity of calciothermal reduction by changing the oxide content of the mixture, which corresponds in its composition to the desired alloy, by fulfilling a temperature condition that $T_M > T_R \geqq 0.9\ T_M$, wherein $T_M$ being the melting temperature in degrees Kelvin of the intermetallic phase and $T_R$ being the reduction temperature;

a2) the mixture comprising of components, with the exception of Calcium, having an average particle size of ≦75 μm;

a3) tempering the reaction product at the end of the exothermic reaction at a temperature, which is at least 0.7 times the melting temperature $T_M$ of the desired alloy, but is less than the melting temperature $T_M$, during a period of time adequate for diffusion of the components; and b) subsequently nitriding the reaction product thus obtained with nitrogen or a mixture of nitrogen and hydrogen or $NH_3$ in a temperature range between 473° K. and a temperature below the decomposition temperature of the nitride of formula $Se_2Fe_{17-x}TM_xN_y$.

2. The method of claim 1, further comprising that after step a3) but before step b), reacting upon the tempered reaction product with hydrogen up to, at most, the saturation of the alloy with hydrogen in a temperature range between room temperature and the decomposition temperature of the hydride of the alloy formed in steps a1) to a3) of the method.

3. The method of claim 2, comprising the hydrogen being removed by the application of a vacuum before the product is nitrided.

4. The method of claims 1, 2 or 3, comprising that an alloy with a particle size of 5 to 100 μm is selected for step b) of the method.

* * * * *